US008075732B2

(12) United States Patent
Partlo et al.

(10) Patent No.: US 8,075,732 B2
(45) Date of Patent: Dec. 13, 2011

(54) EUV COLLECTOR DEBRIS MANAGEMENT

(75) Inventors: William N. Partlo, Poway, CA (US); Richard L. Sandstrom, Encinitas, CA (US); Igor V. Fomenkov, San Diego, CA (US); Alexander I. Ershov, San Diego, CA (US); William Oldham, Orinda, CA (US); William F. Marx, San Diego, CA (US); Oscar Hemberg, La Jolla, CA (US)

(73) Assignee: Cymer, Inc., San Diego, CA (US)

( * ) Notice: Subject to any disclaimer, the term of this patent is extended or adjusted under 35 U.S.C. 154(b) by 248 days.

(21) Appl. No.: 10/979,945

(22) Filed: Nov. 1, 2004

(65) Prior Publication Data

US 2006/0091109 A1 May 4, 2006

(51) Int. Cl.
*C23F 1/00* (2006.01)

(52) U.S. Cl. ..... 156/345.35; 156/345.39; 156/345.42; 156/345.5; 438/708; 438/709

(58) Field of Classification Search ..... 156/345.35, 156/345.39, 345.42, 345.5; 438/708, 709
See application file for complete search history.

(56) References Cited

U.S. PATENT DOCUMENTS

| | | | | |
|---|---|---|---|---|
| 2,759,106 | A | 8/1956 | Wolter | 250/53 |
| 3,150,483 | A | 9/1964 | Mayfield et al. | 60/35.5 |
| 3,232,046 | A | 2/1966 | Meyer | 50/35.5 |
| 3,279,176 | A | 10/1966 | Boden | 60/202 |

(Continued)

FOREIGN PATENT DOCUMENTS

EP 1643310 5/2006

(Continued)

OTHER PUBLICATIONS

Andreev, et al., "Enhancement of laser/EUV conversion by shaped laser pulse interacting with Li-contained targets for EUV lithography", Proc. Of *SPIE*, 5196:128-136, (2004).

(Continued)

*Primary Examiner* — Binh X Tran

(57) ABSTRACT

A method and apparatus that may comprise an EUV light producing mechanism utilizing an EUV plasma source material comprising a material that will form an etching compound, which plasma source material produces EUV light in a band around a selected center wavelength comprising: an EUV plasma generation chamber; an EUV light collector contained within the chamber having a reflective surface containing at least one layer comprising a material that does not form an etching compound and/or forms a compound layer that does not significantly reduce the reflectivity of the reflective surface in the band; an etchant source gas contained within the chamber comprising an etchant source material with which the plasma source material forms an etching compound, which etching compound has a vapor pressure that will allow etching of the etching compound from the reflective surface. The etchant source material may comprises a halogen or halogen compound. The etchant source material may be selected based upon the etching being stimulated in the presence of photons of EUV light and/or DUV light and/or any excited energetic photons with sufficient energy to stimulate the etching of the plasma source material. The apparatus may further comprise an etching stimulation plasma generator providing an etching stimulation plasma in the working vicinity of the reflective surface; and the etchant source material may be selected based upon the etching being stimulated by an etching stimulation plasma. There may also be an ion accelerator accelerating ions toward the reflective surface. The ions may comprise etchant source material. The apparatus and method may comprise a part of an EUV production subsystem with an optical element to be etched of plasma source material.

21 Claims, 14 Drawing Sheets

U.S. PATENT DOCUMENTS

| | | | | |
|---|---|---|---|---|
| 3,746,870 | A | 7/1973 | Demarest | 250/227 |
| 3,960,473 | A | 6/1976 | Harris | 425/467 |
| 3,961,197 | A | 6/1976 | Dawson | 250/493 |
| 3,969,628 | A | 7/1976 | Roberts et al. | 250/402 |
| 4,042,848 | A | 8/1977 | Lee | 313/231.6 |
| 4,088,966 | A | 5/1978 | Samis | 313/231.5 |
| 4,143,275 | A | 3/1979 | Mallozzi et al. | 250/503 |
| 4,162,160 | A | 7/1979 | Witter | 75/246 |
| 4,203,393 | A | 5/1980 | Giardini | 123/30 |
| 4,364,342 | A | 12/1982 | Asik | 123/143 |
| 4,369,758 | A | 1/1983 | Endo | 123/620 |
| 4,504,964 | A | 3/1985 | Cartz et al. | 378/119 |
| 4,507,588 | A | 3/1985 | Asmussen et al. | 315/39 |
| 4,536,884 | A | 8/1985 | Weiss et al. | 378/119 |
| 4,538,291 | A | 8/1985 | Iwamatsu | 378/119 |
| 4,561,406 | A | 12/1985 | Ward | 123/536 |
| 4,596,030 | A | 6/1986 | Herziger et al. | 378/119 |
| 4,618,971 | A | 10/1986 | Weiss et al. | 378/34 |
| 4,626,193 | A | 12/1986 | Gann | 431/71 |
| 4,633,492 | A | 12/1986 | Weiss et al. | 378/119 |
| 4,635,282 | A | 1/1987 | Okada et al. | 378/34 |
| 4,751,723 | A | 6/1988 | Gupta et al. | 378/119 |
| 4,752,946 | A | 6/1988 | Gupta et al. | 378/119 |
| 4,774,914 | A | 10/1988 | Ward | 123/162 |
| 4,837,794 | A | 6/1989 | Riordan et al. | 378/119 |
| 4,928,020 | A | 5/1990 | Birx et al. | 307/106 |
| 5,023,897 | A | 6/1991 | Neff et al. | 378/122 |
| 5,027,076 | A | 6/1991 | Horsley et al. | 324/674 |
| 5,102,776 | A | 4/1992 | Hammer et al. | 430/311 |
| 5,126,638 | A | 6/1992 | Dethlefsen | 315/326 |
| 5,142,166 | A | 8/1992 | Birx | 307/419 |
| 5,175,755 | A | 12/1992 | Kumakhov | 378/34 |
| 5,313,481 | A | 5/1994 | Cook et al. | 372/37 |
| 5,319,695 | A | 6/1994 | Itoh et al. | 378/84 |
| RE34,806 | E | 12/1994 | Cann | 427/446 |
| 5,411,224 | A | 5/1995 | Dearman et al. | 244/53 |
| 5,448,580 | A | 9/1995 | Birx et al. | 372/38 |
| 5,504,795 | A | 4/1996 | McGeoch | 378/119 |
| 5,577,092 | A * | 11/1996 | Kublak et al. | 378/119 |
| 5,729,562 | A | 3/1998 | Birx et al. | 372/38 |
| 5,763,930 | A | 6/1998 | Partlo | 250/504 |
| 5,866,871 | A | 2/1999 | Birx | 219/121 |
| 5,936,988 | A | 8/1999 | Partlo et al. | 372/38 |
| 5,963,616 | A | 10/1999 | Silfvast et al. | 378/122 |
| 6,031,241 | A | 2/2000 | Silfvast et al. | 250/504 |
| 6,039,850 | A | 3/2000 | Schulz | 204/192.15 |
| 6,051,841 | A | 4/2000 | Partlo | 250/504 |
| 6,064,072 | A | 5/2000 | Partlo et al. | 250/504 |
| 6,172,324 | B1 | 1/2001 | Birx | 219/121.57 |
| 6,195,272 | B1 | 2/2001 | Pascente | 363/21 |
| 6,285,743 | B1 | 9/2001 | Kondo et al. | 378/119 |
| 6,304,630 | B1 | 10/2001 | Bisschops et al. | 378/119 |
| 6,307,913 | B1 | 10/2001 | Foster et al. | 378/34 |
| 6,377,651 | B1 | 4/2002 | Richardson et al. | 378/34 |
| 6,396,900 | B1 | 5/2002 | Barbee, Jr. et al. | 378/84 |
| 6,452,194 | B2 | 9/2002 | Bijkerk et al. | 250/492.2 |
| 6,452,199 | B1 | 9/2002 | Partlo et al. | 250/504 |
| 6,493,423 | B1 | 12/2002 | Bisschops | 378/119 |
| 6,566,667 | B1 | 5/2003 | Partlo et al. | 250/504 |
| 6,566,668 | B2 | 5/2003 | Rauch et al. | 250/504 |
| 6,576,912 | B2 | 6/2003 | Visser et al. | 250/492.2 |
| 6,586,757 | B2 | 7/2003 | Melnychuk et al. | 250/504 |
| 6,589,709 | B1 * | 7/2003 | Okoroanyanwu et al. | 430/296 |
| 6,590,959 | B2 | 7/2003 | Kandaka et al. | 378/119 |
| 6,647,086 | B2 | 11/2003 | Amemiya et al. | 378/34 |
| 6,744,060 | B2 | 6/2004 | Ness et al. | 315/111.01 |
| 6,804,327 | B2 | 10/2004 | Schriever et al. | 378/119 |
| 6,815,700 | B2 | 11/2004 | Melnychuk et al. | 250/504 |
| 6,865,255 | B2 | 3/2005 | Richardson | 378/119 |
| 6,893,975 | B1 * | 5/2005 | Yue et al. | 438/714 |
| 6,968,850 | B2 * | 11/2005 | Chan et al. | 134/1.1 |
| 7,026,629 | B2 * | 4/2006 | Bakker et al. | 250/423 P |
| 7,116,394 | B2 | 10/2006 | Bakker et al. | |
| 2001/0006217 | A1 | 7/2001 | Bisschops | 250/493.1 |
| 2002/0168049 | A1 * | 11/2002 | Schriever et al. | 378/119 |
| 2003/0006708 | A1 * | 1/2003 | Leung et al. | 315/111.81 |
| 2003/0068012 | A1 | 4/2003 | Ahmad et al. | 378/119 |
| 2003/0219056 | A1 | 11/2003 | Yager et al. | 372/57 |
| 2004/0179178 | A1 * | 9/2004 | Emoto | 355/53 |
| 2004/0208286 | A1 * | 10/2004 | Richardson | 378/119 |
| 2004/0227102 | A1 * | 11/2004 | Kurt et al. | 250/491.1 |

FOREIGN PATENT DOCUMENTS

| | | |
|---|---|---|
| JP | 2000091096 A | 3/2000 |
| JP | 2004-273864 | 7/2004 |
| WO | WO2004/104707 | 12/2004 |
| WO | WO2006020080 | 2/2006 |

OTHER PUBLICATIONS

Apruzese, J.P., "X-Ray Laser Research Using Z Pinches," *Am. Inst. of Phys*. 399-403, (1994).

Bollanti, et al., "Compact Three Electrodes Excimer Laser IANUS for a POPA Optical System," *SPIE Proc*. (2206)144-152, (1994).

Bollanti, et al., "Ianus, the three-electrode excimer laser," *App. Phys. B* (*Lasers & Optics*) 66(4):401-406, (1998).

Braun, et al., "Multi-component EUV Multilayer Mirrors," *Proc. SPIE*, 5037:2-13, (2003).

Choi, et al., "A $10^{13}$ A/s High Energy Density Micro Discharge Radiation Source," *B. Radiation Characteristics*, p. 287-290.

Choi, et al., "Fast pulsed hollow cathode capillary discharge device," *Rev. of Sci. Instrum*. 69(9):3118-3122 (1998).

Choi et al., Temporal development of hard and soft x-ray emission from a gas-puff Z pinch, Rev. Sci. Instrum. 57(8), pp. 2162-2164 (Aug. 1986).

Feigl, et al., "Heat Resistance of EUV Multilayer Mirrors for Long-time Applications," *Microelectric Engineering*, 57-58:3-8, (2001).

Fomenkov, et al., "Characterization of a 13.5nm Source for EUV Lithography based on a Dense Plasma Focus and Lithium Emission," Sematech Intl. Workshop on EUV Lithography (Oct. 1999).

Giordano and Letardi, "Magnetic pulse compressor for prepulse discharge in spiker-sustainer excitati technique for XeCl lasers," Rev. Sci. Instrum 65(8), pp. 2475-2481 (Aug. 1994).

Hansson, et al., "Xenon liquid jet laser-plasma source for EUV lithography," Emerging Lithographic Technologies IV, *Proc. Of SPIE*, vol. 3997:729-732 (2000).

Jahn, Physics of Electric Propulsion, McGraw-Hill Book Company, (Series in Missile and Space U.S.A.), Chap. 9, "Unsteady Electromagnetic Acceleration," p. 257 (1968).

Kato, Yasuo, "Electrode Lifetimes in a Plasma Focus Soft X-Ray Source," *J. Appl. Phys*. (33) Pt. 1, No. 8:4742-4744 (1991).

Kato, et al., "Plasma focus x-ray source for lithography," *Am. Vac. Sci. Tech. B*., 6(1): 195-198 (1988).

Lebert, et al., "Soft x-ray emission of laser-produced plasmas using a low-debris cryogenic nitrogen target," *J. App. Phys*., 84(6):3419-3421 (1998).

Lebert, et al., "A gas discharged based radiation source for EUV-lithography," Intl. Conf. Micro and Nano-Engineering 98 (Sep. 22-24, 1998) Leuven, Belgium.

Lebert, et al., "Investigation of pinch plasmas with plasma parameters promising ASE," Inst. Phys. Conf. Ser No. 125: Section 9, pp. 411-415 (1992) Schiersee, Germany.

Lebert, et al., "Comparison of laser produced and gas discharge based EUV sources for different applications," Intl. Conf. Micro- and Nano-Engineering 98 (Sep. 22-24, 1998) Leuven, Belgium.

Lee, Ja H., "Production of dense plasmas in hypocycloidal pinch apparatus," *The Phys. Of Fluids*, 20(2):313-321 (1977).

Lewis, Ciaran L.S., "Status of Collision-Pumped X-ray Lasers," *Am. Inst. Phys*. pp. 9-16 (1994).

Lowe, "Gas plasmas yield X-rays for Lithography," Electronics, pp. 40-41 (Jan. 27, 1982).

Malmqvist, et al., "Liquid-jet target for laser-plasma soft x-ray generation," *Am. Inst. Phys*. 67(12):4150-4153 1996).

Mather, "Formation of a High-Density Deuterium Plasma Focus," The Physics of Fluids, 8(2), 366-377 (Feb. 1965).

Mather, et al., "Stability of the Dense Plasma Focus," *Phys. Of Fluids*, 12(11):2343-2347 (1969).

Matthews and Cooper, "Plasma sources for x-ray lithography," SPIE, 333, Submicron Lithography, pp. 136-139 (1982).

Mayo, et al., "A magnetized coaxial source facility for the generation of energetic plasma flows," *Sci. Technol*. vol. 4:pp. 47-55 (1994).

Mayo, et al., "Initial Results on high enthalpy plasma generation in a magnetized coaxial source," *Fusion Tech* vol. 26:1221-1225 (1994).
Nilsen, et al., "Analysis of resonantly photopumped Na-Ne x-ray-laser scheme," *Am Phys. Soc*. 44(7):4591-4597 (1991).
Orme, et al., "Electrostatic charging and deflection of nonconventional droplet streams formed from capillary stream breakup," *Physics of Fluids*, 12(9):2224-2235, (Sep. 2000).
Orme, et al., "Charged Molten Metal Droplet Deposition As a Direct Write Technology", MRS 2000 Spring Meeting, San Francisco, (Apr. 2000).
Pant, et al., "Behavior of expanding laser produced plasma in a magnetic field," *Physica Sripta*, T75:104-111, (1998).
Partlo, et al., "EUV (13.5nm) Light Generation Using a Dense Plasma Focus Device," *SPIE Proc. On Emerging Lithographic Technologies III*, vol. 3676, 846-858 (Mar. 1999).
Pearlman and Riordan, "X-ray lithography using a pulsed plasma source," J. Vac. Sci. Technol., pp. 1190-1193 (Nov./Dec. 1981).
Porter, et al., "Demonstration of Population Inversion by Resonant Photopumping in a Neon Gas Cell Irradiated by a Sodium Z Pinch," *Phys. Rev. Let.*, 68(6):796-799, (Feb. 1992).
Price, Robert H., "X-Ray Microscopy using Grazing Incidence Reflection Optics," *Am. Inst. Phys*. pp. 189-199, (1981).
Qi, et al., "Fluorescence in Mg IX emission at 48.340 ø from Mg pinch plasmas photopumped by Al XI line radiation at 48.338 ø," *The Am. Phys. Soc.*, 47(3):2253-2263 (Mar. 1993).
Scheuer, et al., "A Magnetically-Nozzled, Quasi-Steady, Multimegawatt, Coaxial Plasma Thruster," *IEEE: Transactions on Plasma Science*, 22(6) (Dec. 1994).
Schriever, et al., "Laser-produced lithium plasma as a narrow-band extended ultraviolet radiation source for photoelectron spectroscopy," *App. Optics*, 37(7):1243-1248, (Mar. 1998).
Schriever, et al., "Narrowband laser produced extreme ultraviolet sources adapted to silicon/molybdenum multilayer optics," *J. of App. Phys.*, 83(9):4566-4571, (May 1998).
Shiloh et al., "Z Pinch of a Gas Jet," Physical Review Lett., 40(8), pp. 515-518 (Feb. 20, 1978).
Silfvast, et al., "High-power plasma discharge source at 13.5 nm and 11.4 nm for EUV lithography," *SPIE*, vol. 3676:272-275, (Mar. 1999).
Silfvast, et al., "Lithium hydride capillary discharge creates x-ray plasma at 13.5 namometers," *Laser Focus World*, p. 13. (Mar. 1997).
Stallings et al., "Imploding argon plasma experiments," Appl. Phys. Lett., 35(7), pp. 524-526 (Oct. 1, 1979).
Tillack, et al., "Magnetic Confinement of an Expanding Laser-Produced Plasma", UC San Diego, Center for Energy Research, UCSD Report & Abramova—Tornado Trap.
Wilhein, et al., "A slit grating spectrograph for quantitative soft x-ray spectroscopy," Am. Inst. Of Phys. Rev. of Sci. Instrum., 70(3):1694-1699, (Mar. 1999).
Wu, et al., "The vacuum Spark and Spherical Pinch X-ray/EUV Point Sources," *SPIE, Conf. On Emerging Tech. III*, Santa Clara, CA, vol. 3676:410-420, (Mar. 1999).
Zombeck, M.V., "Astrophysical Observations with High Resolution X-ray Telescope," *Am. Inst. of Phys.*, pp. 200-209, (1981).
Translation of Official Action dated May 9, 2011 from Japanese associate re: Japanese Patent Application No. JP 2007-538994, filed Oct. 20, 2005 (2 pages).
European Search Report, dated Jul. 27, 2011, in related European Patent Application No. 05851232.8, filed Oct. 20, 2005 6 pages.

* cited by examiner

EUV COLLECTOR DEBRIS MANAGEMENT

RELATED APPLICATIONS

This application is related to U.S. patent application Ser. No. 10/409,254, entitled EXTREME ULTRAVIOLET LIGHT SOURCE, filed on Apr. 8, 2003, now U.S. Pat. No. 6,972,421, issued on Dec. 6, 2005, and Ser. No. 10/798,740, entitled COLLECTOR FOR EUV LIGHT SOURCE, filed on Mar. 10, 2004, now U.S. Pat. No. 7,217,940, issued on May 15, 2007, and Ser. No. 10/615,321, entitled A DENSE PLASMA FOCUS RADIATION SOURCE, filed on Jul. 7, 2003, now U.S. Pat. No. 6,952,267, issued on Oct. 4, 2005, and Ser. No. 10/742,233, entitled DISCHARGE PRODUCED PLASMA EUV LIGHT SOURCE, filed on Dec. 18, 2003, now U.S. Pat. No. 7,180,081, issued on Feb. 20, 2007, and Ser. No. 10/803,526, entitled A HIGH REPETITION RATE LASER PRODUCED PLASMA EUV LIGHT SOURCE, filed on Mar. 17, 2004, now U.S. Pat. No. 7,087,914 issued on Aug. 8, 2006, and Ser. No. 10/442,544, entitled A DENSE PLASMA FOCUS RADIATION SOURCE, filed on May 21, 2003, now U.S. Pat. No. 7,002,168, issued on Feb. 21, 2006, and Ser. No. 10/900,836, entitled EUV LIGHT SOURCE, filed on Jul. 27, 2004, now U.S. Pat. No. 7,164,144, issued on Jan. 16, 2007, all assigned to the common assignee of the present application, the disclosures of each of which are hereby incorporated by reference.

FIELD OF THE INVENTION

The present invention relates to plasma produced Extreme Ultraviolet ("EUV") light generation debris management.

BACKGROUND OF THE INVENTION

EUV light generation utilizing a plasma formed from metals such as tin in the form of a target for plasma initiation by irradiation of the target, e.g., a droplet of liquid tin in a laser produced plasma EUV light generator or in a discharged produced deep plasma focus produced plasma using, e.g., tin, as the plasma source have been proposed in the art. A problem with tin in such applications has been the removal of plasma produced debris from optical surfaces in the EUV light source production chamber. Such optical surfaces may be, e.g., reflective surfaces, e.g., in a collector, e.g., using mutilayer mirrors with many stacked layers forming the reflecting optic or a few layers forming a grazing angle of incidence reflecting surface or may be transmitting surfaces, e.g., lenses and windows used, e.g., to direct and/or focus a laser beam(s) on the plasma production target for LPP or for various metrology uses. Lithium, tin and Xenon, among other elements have been proposed as plasma production source materials for plasma produced EUV light generation, both of the discharged produced plasma ("DPP") variety, otherwise sometimes referred to as Dense Plasma Focus ("DPF"P or Dense Plasma Pinch ("DPP") or the Laser Produced Plasma ("LPP") variety. One of the troubling aspects of tin as a target according to the art is the perceived inability to remove tin from optical elements critical to the operation of the DPP or LPP apparatus for producing EUV light, e.g., the primary collector mirror in either a DPP or LPP system, or from such optics as windows used, e.g., for metrology and/or lenses used for, e.g., metrology and/or focusing or directing of the laser light pulses to the plasma initiation site for LPP. For lithium as discussed, e.g., in the above referenced co-pending applications, several strategies for lithium debris removal exist, e.g., simply heating the reflective surface of the mirror or other optical element to, e.g., about 450-500° C. and evaporate the lithium from the mirror surface.

Tin halides and halides of other possible target materials have been proposed as the source of the target material as discussed in WO03/094581A1, entitled METHOD OF GENERATION F EXTREME ULTRAVIOLET RADIATION, published on Nov. 13, 2003.

Applicants propose various solutions to the difficulties in debris mitigation with such targets as tin.

SUMMARY OF THE INVENTION

A method and apparatus are disclosed that may comprise an EUV light producing mechanism utilizing an EUV plasma source material comprising a material that will form an etching compound, which plasma source material produces EUV light in a band around a selected center wavelength comprising: an EUV plasma generation chamber; an EUV light collector contained within the chamber having a reflective surface containing at least one layer comprising a material that does not form an etching compound and/or forms a compound layer that does not significantly reduce the reflectivity of the reflective surface in the band; an etchant source gas contained within the chamber comprising an etchant source material with which the plasma source material forms an etching compound, which etching compound has a vapor pressure that will allow etching of the etching compound from the reflective surface. The etchant source material may comprises a halogen or halogen compound. The etchant source material may be selected based upon the etching being stimulated in the presence of photons of EUV light and/or DUV light and/or any excited energetic photons with sufficient energy to stimulate the etching of the plasma source material. The apparatus may further comprise an etching stimulation plasma generator providing an etching stimulation plasma in the working vicinity of the reflective surface; and the etchant source material may be selected based upon the etching being stimulated by an etching stimulation plasma. There may also be an ion accelerator accelerating ions toward the reflective surface. The ions may comprise etchant source material. The apparatus and method may comprise an EUV light producing mechanism utilizing an EUV plasma source material comprising a material that will form an etching compound, which plasma source material produces EUV light in a band around a selected center wavelength which may comprise an EUV plasma generation chamber; a subsystem opening in the chamber comprising an optical element within the subsystem opening exposed to EUV, comprising a material that does not form an etching compound and/or forms a compound layer that does not significantly reduce the optical performance of the material; an etchant source gas contained in operative contact with the optical element comprising an etchant source material with which the plasma source material forms an etching compound, which etching compound has a vapor pressure that will allow etching of the etching compound from the optical element. The etchant source material and related gases may be as described above.

BRIEF DESCRIPTION OF THE DRAWINGS

FIGS. 1A-1I show the transmissiveness of various halogen containing gases for light in the EUV range around about 13.51 nm, for 1 mT, 10 mT and 100 mT chamber pressure;

DETAILED DESCRIPTION OF PREFERRED EMBODIMENTS

At least one tin hydride investigated by applicants, e.g., $SnH_4$ has a large vapor pressure at temperatures at or below 450-500° C. and an activation energy to form the compound from a tin halogen (hydrogen) reaction is high and thus requires a large amount of power applied to the mirror surface for formation. Applicants have considered other possible halogen forming compounds (halides and hydrides) made from EUV target materials currently under consideration, e.g., tin.

Some relevant values are shown below in Table I.

TABLE I

| Compound | Melting Point (° C.) | Boiling Point (° C.) |
|---|---|---|
| $SnH_4$ | −146 | −52 |
| $SnF_2$ | 213 | 850 |
| $SnF_4$ | — | 705 |
| $SnCl_2$ | 247 | 623 |
| $SnCl_4$ | −33 | 114 |
| $SnBr_2$ | 216 | 620 |
| $SnBr_4$ | 31 | 202 |
| $SnI_2$ | 320 | 714 |
| $SnI_4$ | 143 | 364 |
| $H_2$ | −259 | −252 |
| $F_2$ | −219 | −188 |
| $Cl_2$ | −101 | −34 |
| $Br_2$ | −73 | 59 |
| $I_2$ | 113 | 184 |
| Xe | −111 | −108 |

The above noted Phillips patent application contains plots of pressure vs. temperature for most of these compounds and shows that most have higher vapor pressure at any given temperature than lithium (lithium's boiling point is 1342° C.).

Applicants have also considered whether acceptable EUV light within a given band, e.g., centered at around 13.5 nm can be obtained with reasonable values of gas pressure. The plots of FIGS. 1A-1I show transmission vs. wavelength for various tin halides according to with the data taken from the CXRO web site. These plots are for three pressures 1 mT, 10 mT and 100 mT, all at 22° C. and through a gas column of one meter. Applicants have also investigated this transmissivity for the same pressures for each compound at 400° C. and found only a small improvement in transmission at the higher temperature. These plots are not expected to be perfectly accurate, but instead give a guide as to an approximate acceptable upper limit of gas pressure.

Figure 1A:
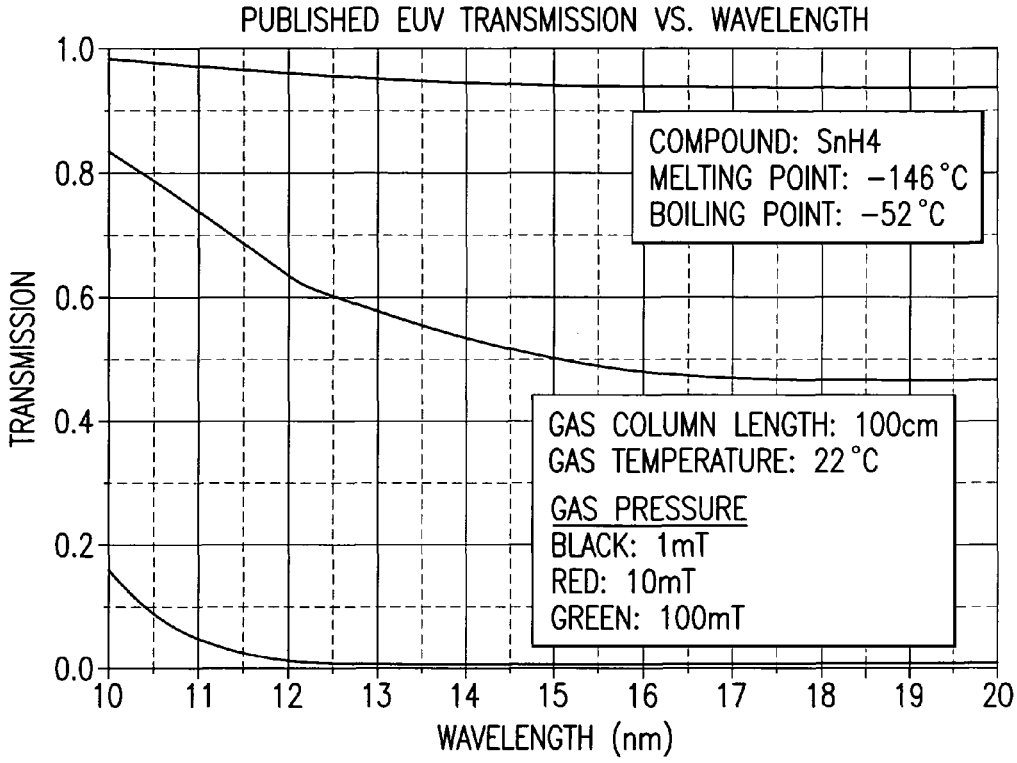
Figure 1B:
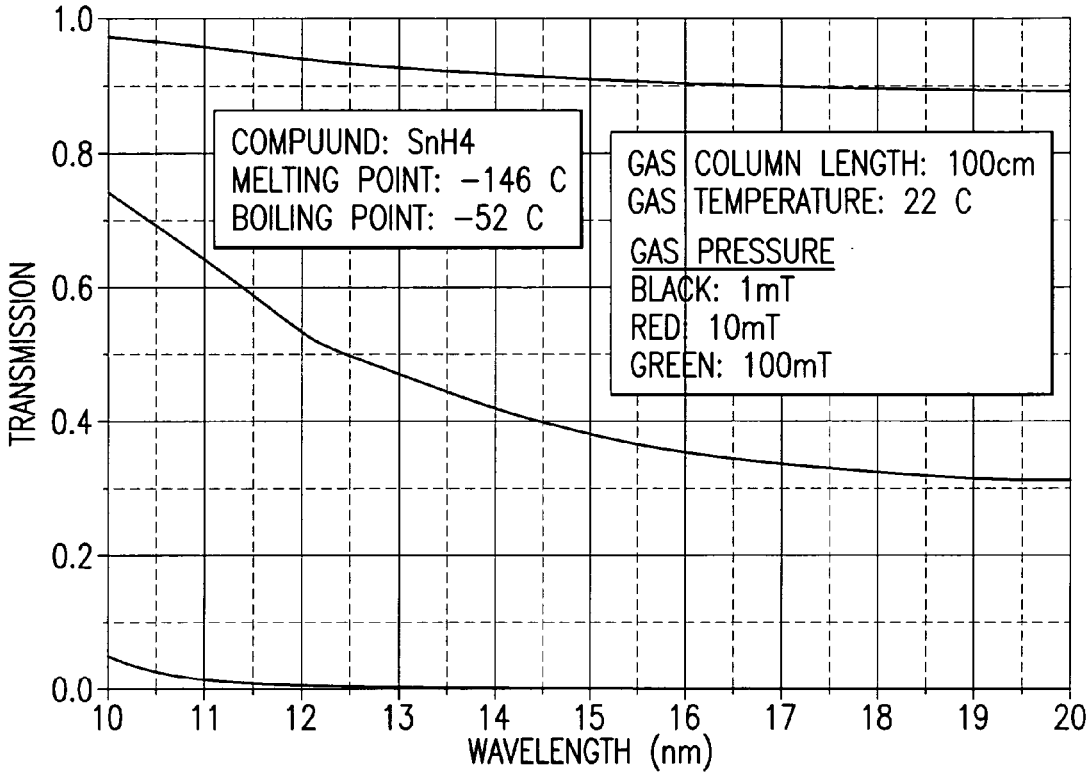
Figure 1C:
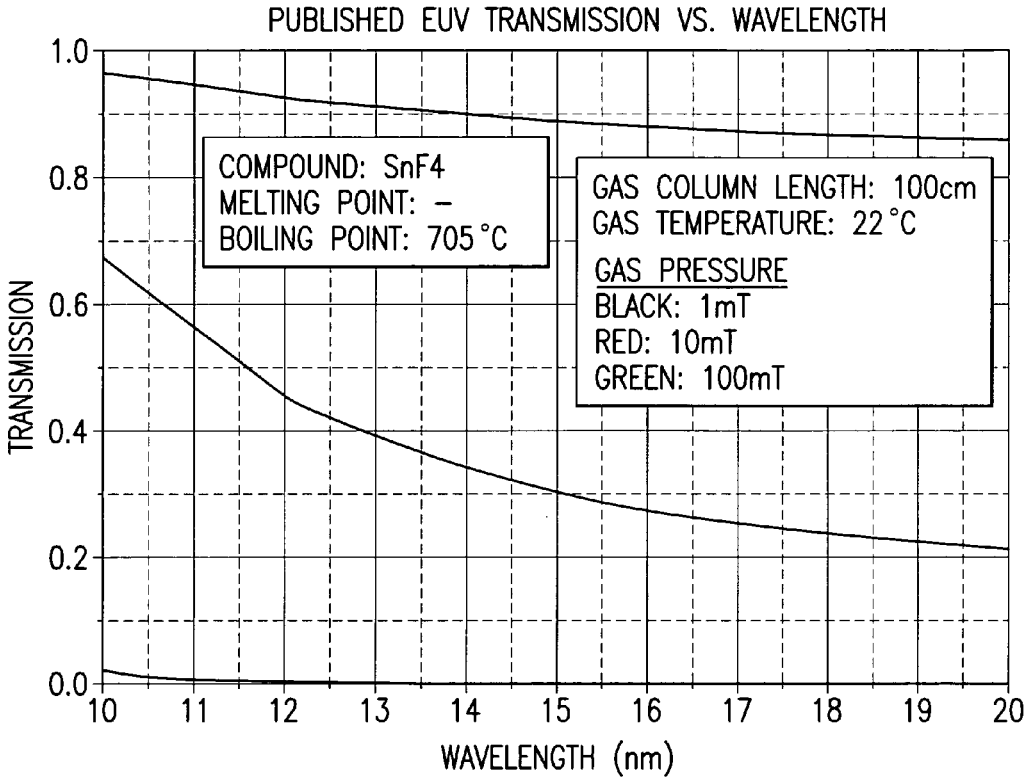
Figure 1D:
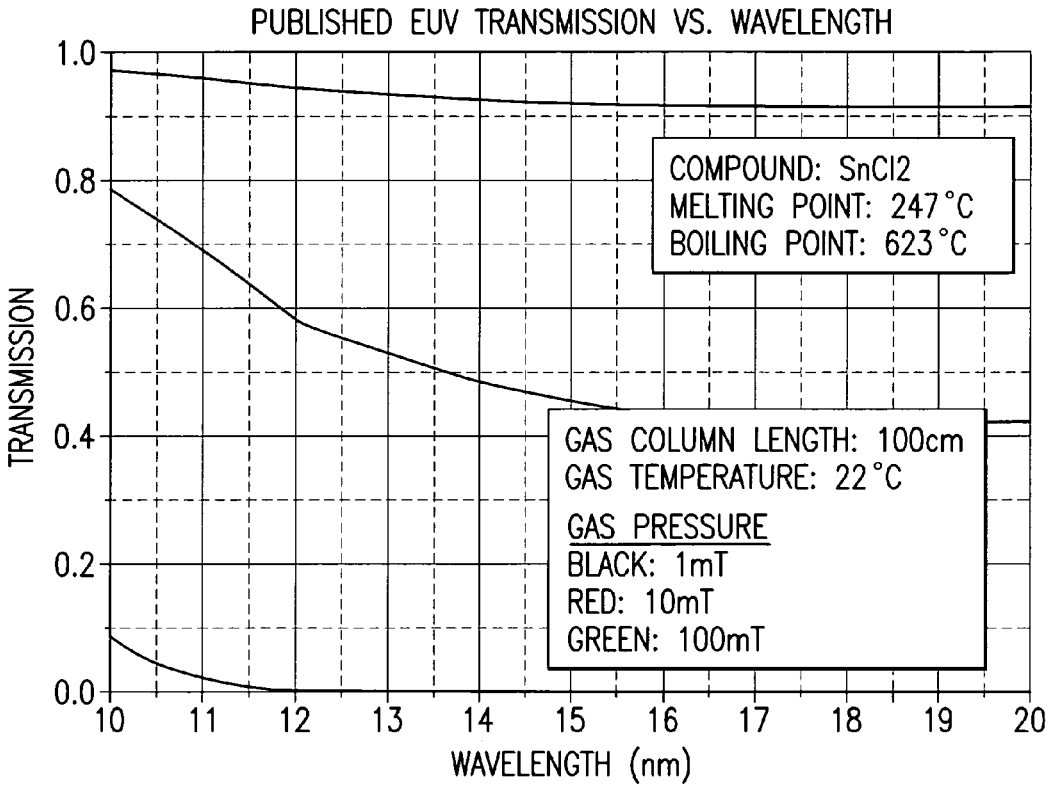
Figure 1E:
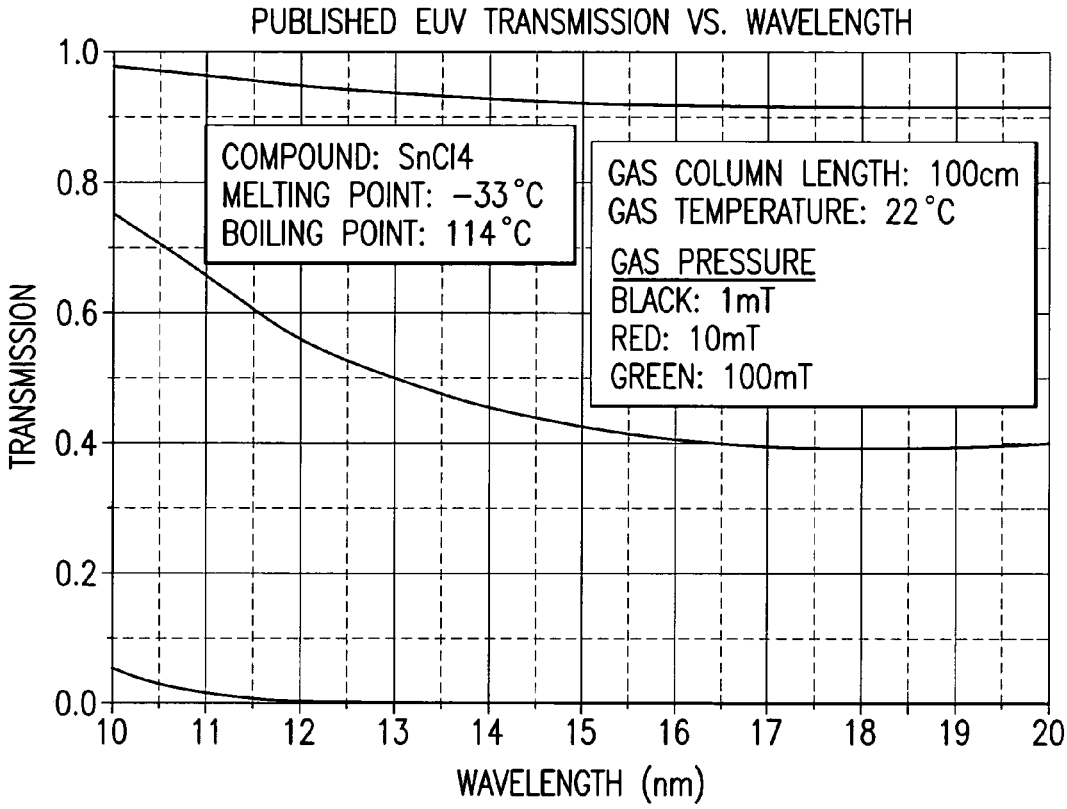
Figure 1F:
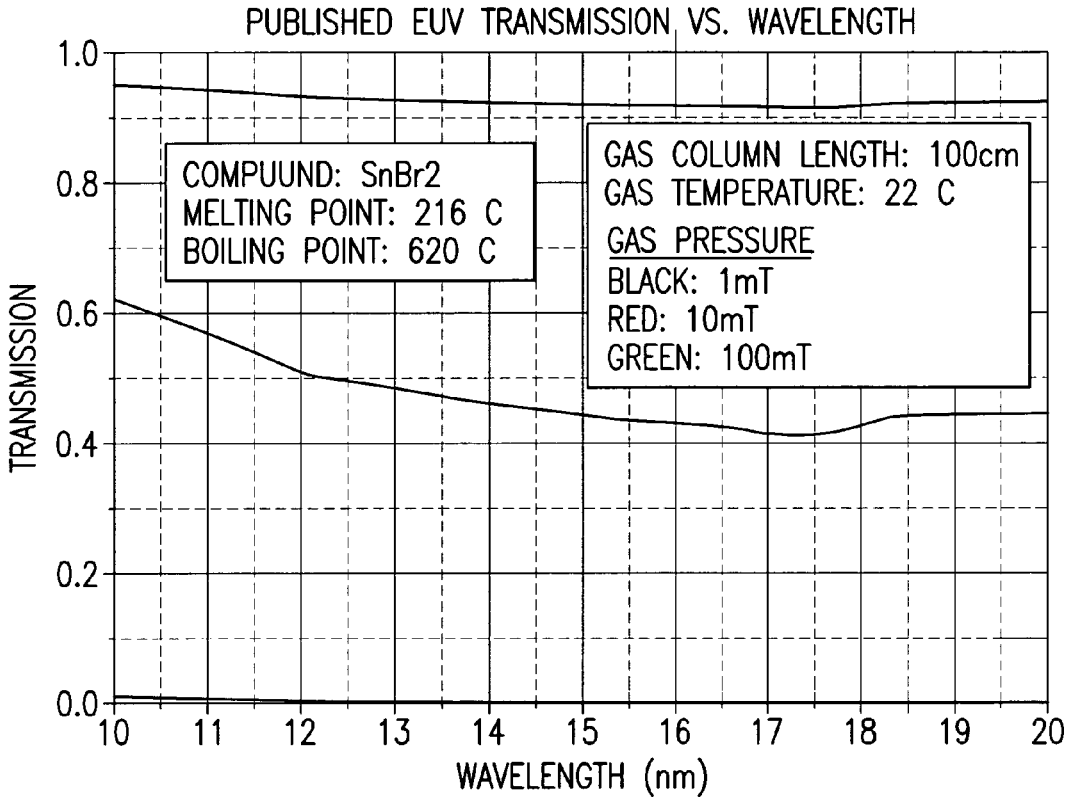
Figure 1G:
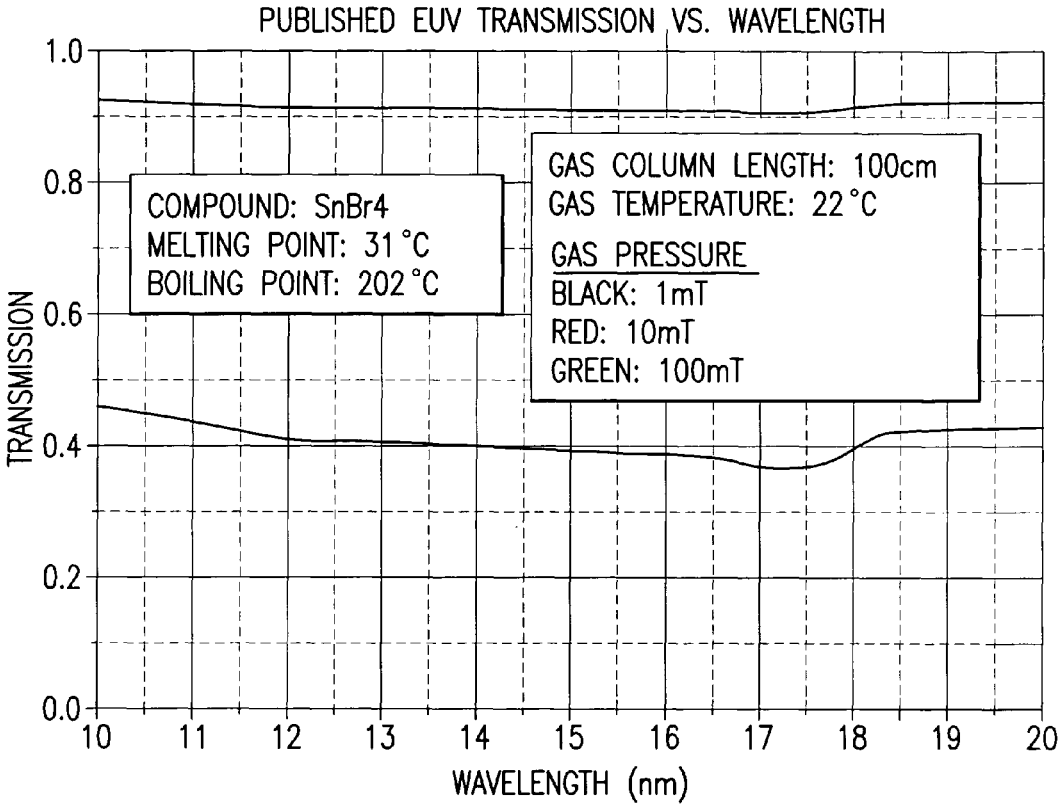
Figure 1H:
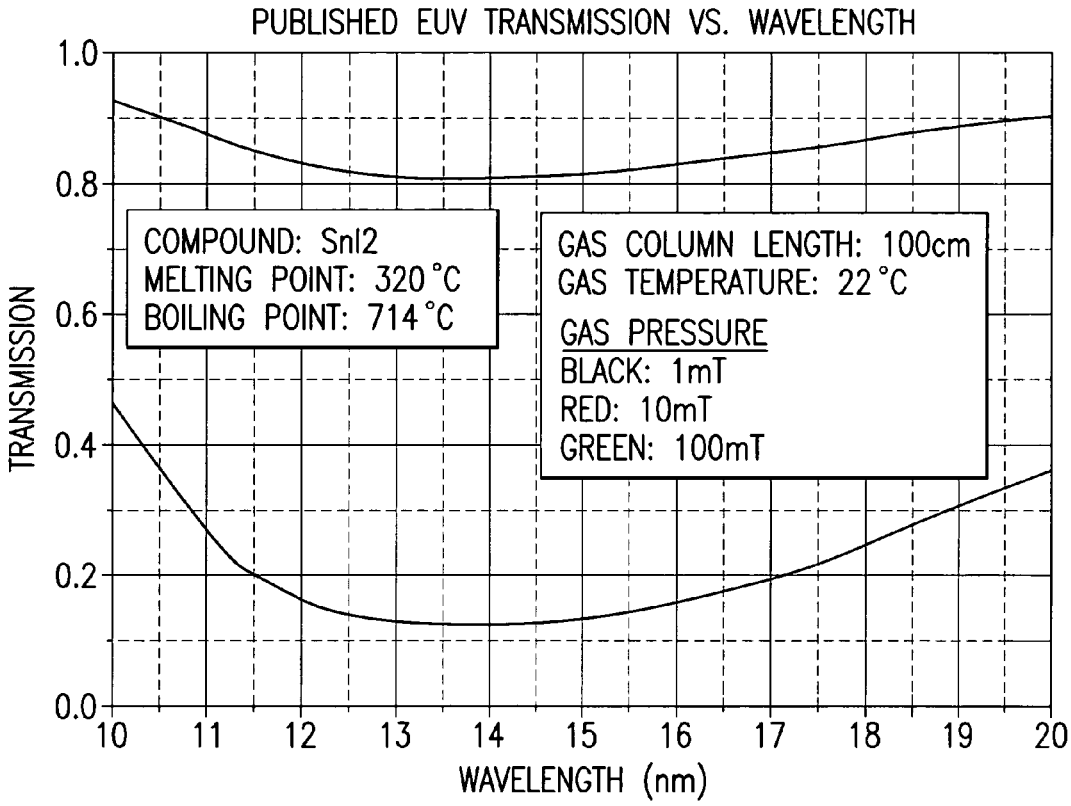
Figure 11:
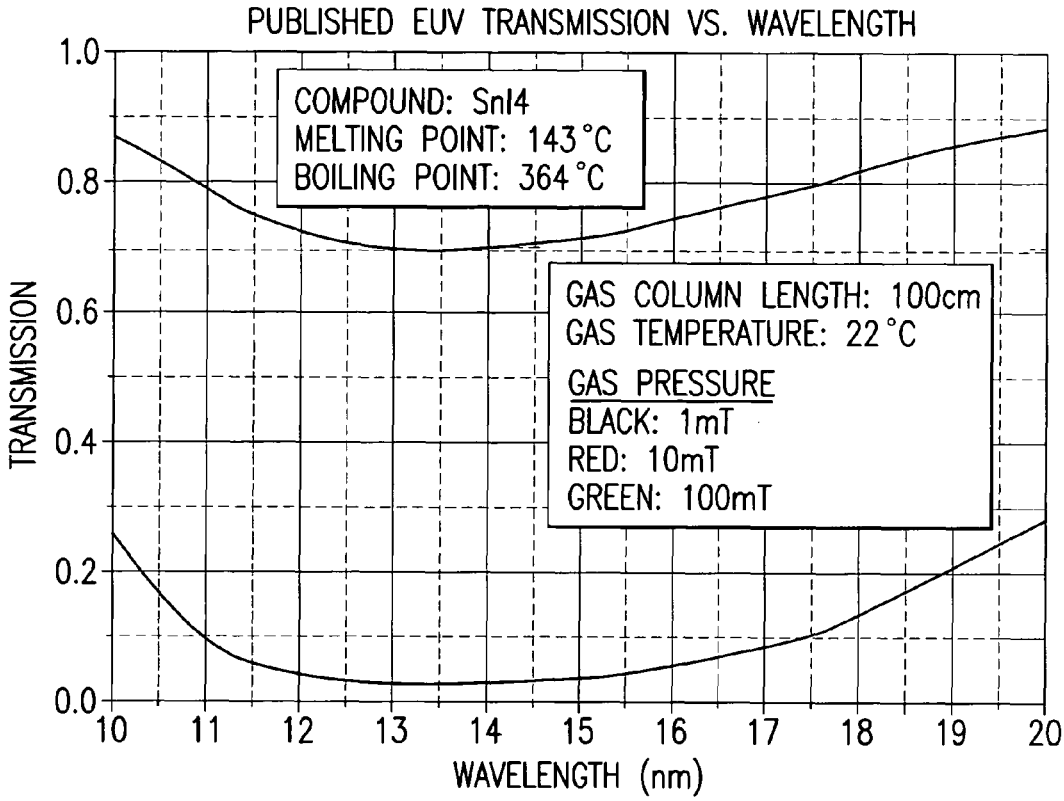
Figure 1J:
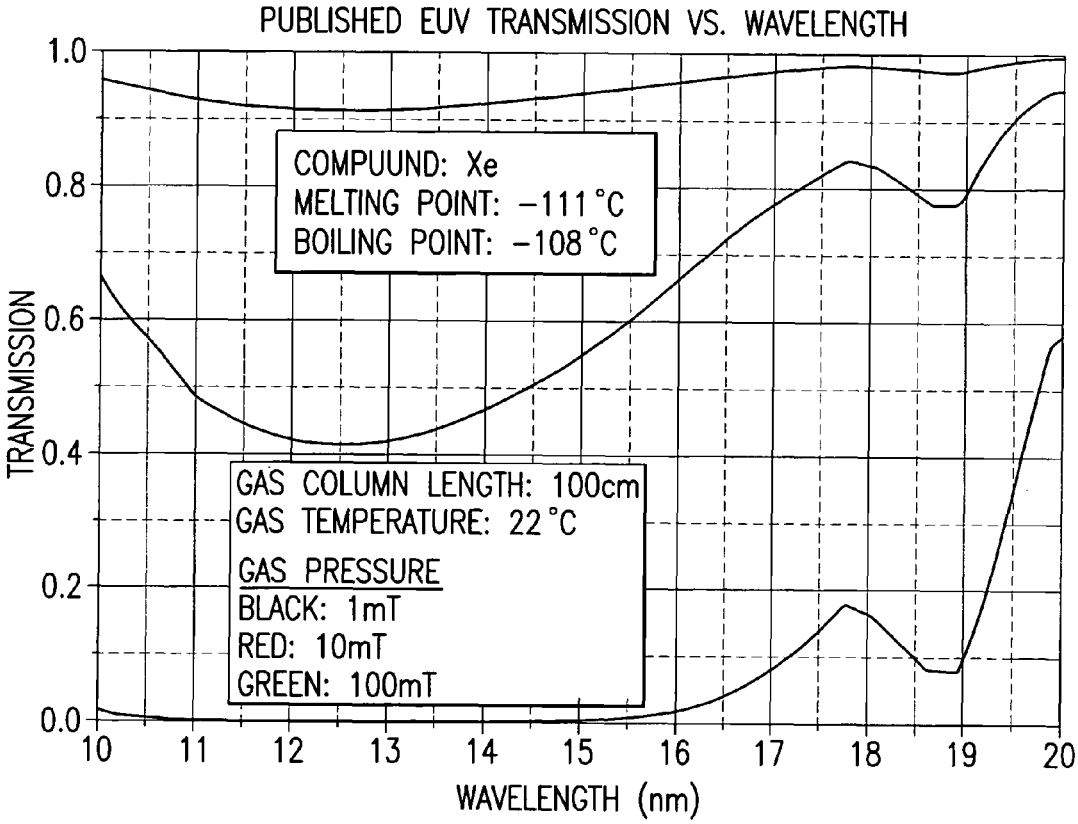
FIG. 1J shows a similar plot for Xenon.

These plots also indicate that, except for the tin iodine compounds, the 13.5 nm absorption is dominated by the tin atom and not the halide. These plots also show that for acceptable transmission, the gas pressure mostly has to be below 10 mT. For comparison, the plot in FIG. 1J shows the EUV transmission of xenon. As can be seen, for Xenon the background pressure must be kept very low due to Xenon's very high absorption around 13.5 nm.

Applicants have examined EUV plasma source material halogen containing compounds, e.g. tin halides, regarding whether or not they will form on the mirror surface and carry away the tin, e.g., in a chemical and/or ion etch process at the surface of an optical element exposed to the debris in the EUV production chamber. While the hydride $SnH_4$ has previously been investigated by applicants in the literature and found to have a high activation energy, rendering the required average power incident, e.g., on the surface of the mirror impractical. Some others may suffer from a similar disadvantage, although other aspects of an environment in the EUV light plasma production chamber, such as the very presence of EUV (and for LPP DUV or other high energy) photons, the presence of induced secondary plasmas in the vicinity of the optical surfaces in question, stimulation of high energy bombardment of the optical surfaces, etc. may contribute to the lowering of the activation energy required and/or provide activation energy such that, as applicants believe, there will be almost no problem in forming halogen containing compounds, e.g., with just about any halogen, and e.g., with a source material debris such as tin. In any event, halogens such as $Cl_2$ and $Br_2$ react readily with tin in the cold (e.g., around room temperature and with $F_2$ and $I_2$ with some moderate warming above room temperature to form "$SnX_4$", where X is Cl, Br, F and I. The vapor pressures for the $SnX_4$ molecules is much higher than for the $SnX_2$ molecules, facilitating its utilization according to aspects of an embodiment of the present invention.

The real issue is to get the halogen containing compound to etch from, i.e., evaporate or be driven from the surface of the optical element and in what ambient environment(s). Chlorine and bromine and their compounds, e.g., HCl and HBr, appear to be the most likely successful cleaning agents, e.g., without additional activation energy stimulation. Hydrogen requires too much activation energy and the tin fluorine compounds may not evaporate from the mirror surface without additional stimulation to add activation energy.

Another issue to address is the prevention of unwanted etching of the material of the optical element, e.g., molybdenum, which, e.g., chlorine will readily do. Bromine and its compounds do not readily react with molybdenum, though it may a elevated temperatures, and appears to applicants to be a good choice for the halogen cleaning agent. The chamber will likely be operated at a temperature where bromine or its compounds are in the gas phase. In addition, one can cryopump the bromine or its compounds and the tin-bromide compounds from the chamber atmosphere utilizing simple water-cooled surfaces.

Figure 2:
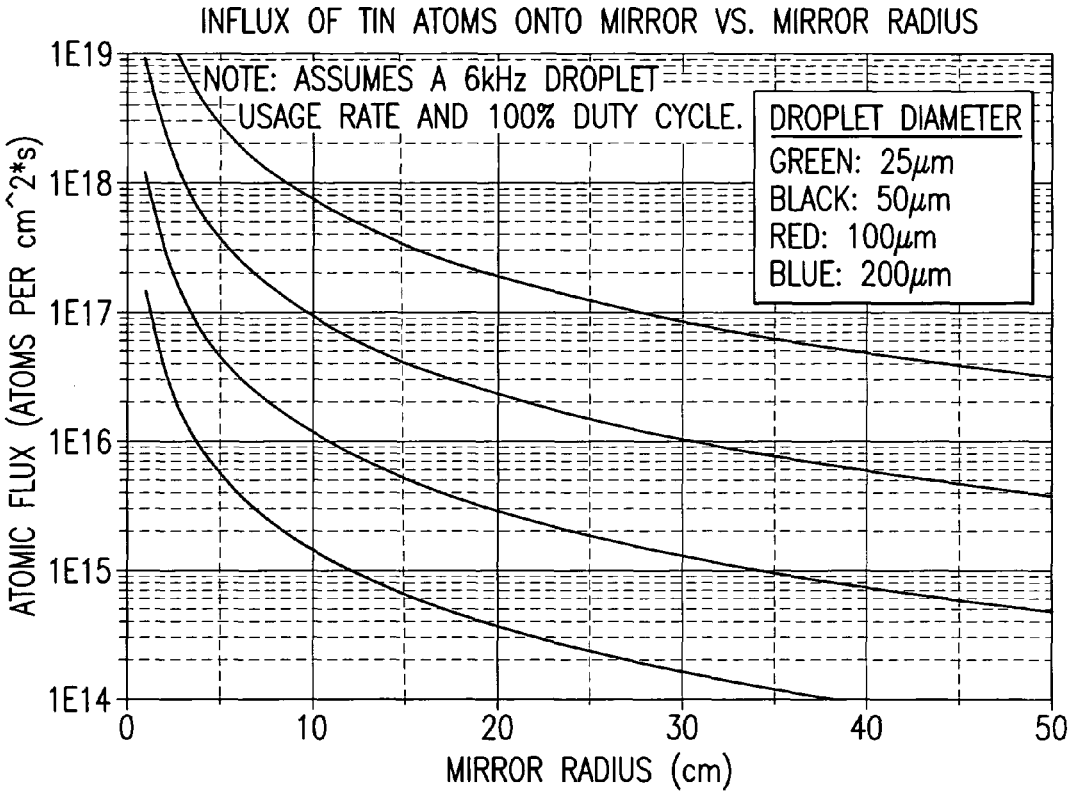
FIG. 2 shows the atomic flux of Tin ions onto mirrors of various radius according to aspects of an embodiment of the present invention.
Figure 3:
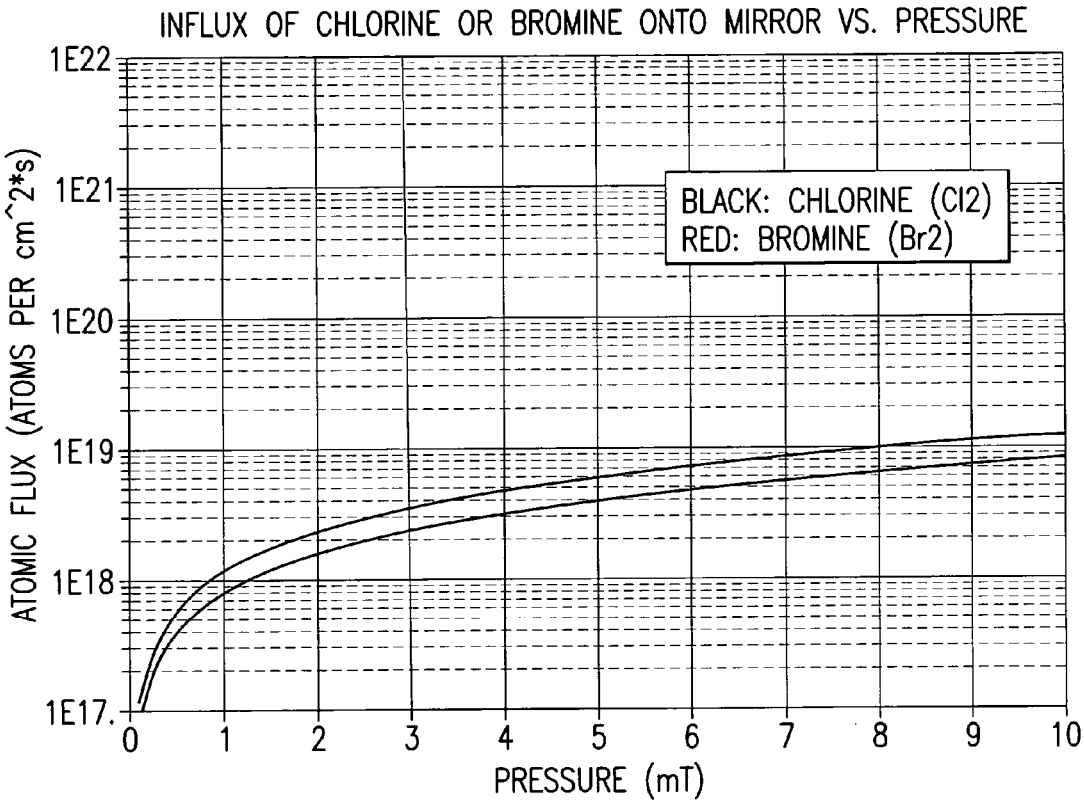
FIG. 3 shows the atomic flux onto a mirror of halogen gases Chlorine and Bromine onto a mirror according to aspects of an embodiment of the present invention.

Applicants have also considered that with a given number of tin atoms deposited on, e.g., the mirror surface per unit time, what buffer pressure of chorine or bromine is required to continuously clean the mirror surface. Based upon the predicted influx rate calculation for tin against the mirror surface as shown in FIG. 2 for a given mirror size and the droplet diameter and the density of tin, per droplet assumed to be spewed evenly from the plasma into a full sphere, the resulting influx rate per unit surface area scales as the square of mirror radius. This influx rate of tin atoms according to aspects of an embodiment of the present invention must be accompanied by a sufficient rate of halogen atoms to form the volatile halogen containing compound, e.g., a tin halide. Given a flux of atoms (molecules) crossing a plane versus pressure and temperature, FIG. 3 shows a plot of the influx rate for chlorine and bromine.

The influx rate of the halogen or halogen containing gas according to aspects of an embodiment of the present invention will be orders of magnitude higher than the tin influx rate for a reasonable choice of mirror radii, e.g., around 20 cm, which may be dictated by other operational considerations, e.g., cooling capability. A tin droplet diameter of 50 m leads to a tin influx rate at the mirror surface of 3 $10^{15}$ atoms/$cm^2$s as compared to a halogen influx rate of greater than 1 $10^{18}$ to $10^{19}$ atoms/$cm^2$s for any reasonable pressure. Thus, there will be plenty of halogen atoms available, and the issue becomes one of the reactivity rate in forming the metal halogen containing compound, e.g., $SnBr_4$. The source of Br may be, e.g., $Br_2$ or HBr gas contained in the plasma formation chamber.

Figure 4:
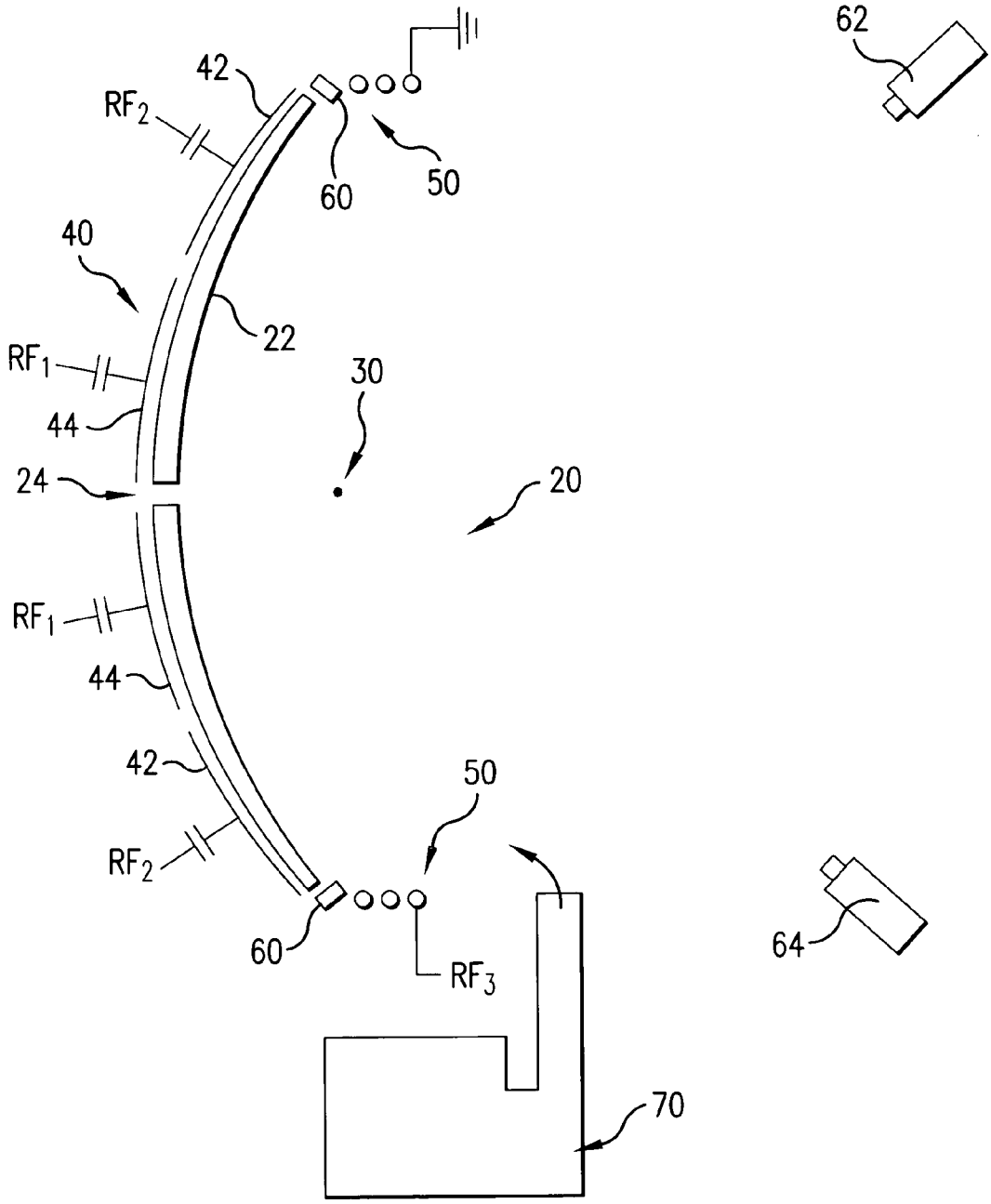
FIG. 4 illustrates schematically a debris mitigation arrangement for an EUV light source collector according to aspects of an embodiment of the present invention.

Turning now to FIG. 4 there is illustrated schematically a collector system 20 for an EUV LPP light source. The system 20 may comprise a collector 22, which may be in the form of a truncated ellipse, with a first focus at a desired plasma initiation site 30, to which targets, e.g., in the form of droplets 92 of liquid source material, e.g., tin, as shown schematically in FIG. 5. The droplets 92 may be delivered by a target delivery system 90, as discussed in more detail in some of the above referenced co-pending applications.

A laser beam(s) 100 may be delivered to the plasma initiation site 30, e.g., through an input and focusing optic 102 (shown in FIG. 5) to cause the formation of a plasma from the target under the irradiation of the laser beam 100. The chamber may be filled with a gas, e.g., a halogen containing gas, e.g., $Br_2$ or HBr or perhaps also HCl, providing a source of a halogen, e.g., Br or Cl, that will react with plasma source metal debris, e.g., tin atoms deposited on the collector 22 reflective surface and window/lens 102 optical surface facing the plasma initiation site 30.

The EUV light producing mechanism utilizing the plasma producing source material, e.g., tin, which comprises a source material that will form a halogen-containing-compound, which source material also produces EUV light from the induced plasma upon laser beam(s) irradiation in a band around a selected center wavelength, e.g., about 13.5 nm. The collector 22 contained within the chamber may have a reflective surface containing at least one layer of a first material, e.g., molybdenum or ruthenium or silicon, or other metals of compounds thereof that does not form halogen containing compounds or forms a halogen containing compound layer (e.g., that does not significantly reduce the reflectivity of the reflective surface in the band). For example, the gas contained within the chamber may comprise a halogen or halogen compound with which the source material forms a halogen containing compound, which halogen containing compound has a vapor pressure that will allow etching of the halogen containing compound from the reflective surface. The gas therefore, constitutes a plasma source material etchant source gas, e.g., including a halogen or one of its compounds, e.g., HBr or $Br_2$. The etching may be purely by evaporation according to aspects of an embodiment of the present invention or may be stimulated, e.g., thermally, e.g., by heating the collector 22 or window/lens 102, by the presence of EUV and/or DUV photon energy, by a secondary plasma generated in the vicinity of the optical element 22, 102 or by a remotely generated plasma from which a source of ions and/or radicals may be introduced into the vicinity of the optical element 22, 102.

The system 20 may include a plurality of radio frequency or microwave (RF) generators that may deliver an $RF_1$ and an $RF_2$ to sectors of RF antennas capacitively coupled to the antennas 42, 44, which may cover the extent of the rear side of the collector 22 shape and deliver RF to induce ions in the vicinity of the collector 22 reflective surface facing the EUV plasma generation site to accelerate toward the reflective surface of the collector 22. These sectors may be segmented into squares, triangles hexagons, or other meshing geometric forma, or portions thereof to cover the surface area of the rear side of the collector to distribute the two or more RF frequencies differentially to different segments of the collector 22 reflective surface. A plasma may be induced in the vicinity of the collector 22, e.g., by RF source 50 connected between an RF source $RF_3$ and ground. this local or in situ plasma at the collector surface may both slow down debris in the form of non-ablated portions of the target 92 ejected from the plasma initiation site before being ionized and high energy ions from the EUV light source plasma, but may in addition serve to induce etching or evaporation of the volatile halogen-source material compound from the reflecting surfaces of the collector 22. The RF sector antennas 42, 44 inducing ions from the plasma to mechanically induce etching of the halogen-source material compound by reactive ion etching.

The in situ plasma in the working vicinity of the collector may be generated to both stimulate etching of the EUV plasma source material from, e.g., the collector 22, but also to chosen to block ions from reaching, e.g., the reflective surface of the collector 22, or at least slow them down significantly enough to avoid, e.g., sputtering of the reflective surface material(s) from the collector 22 reflective surface.

A remote plasma source 70 may be provided where, e.g., through RF inducement a plasma is formed comprising, e.g., ions in the form of radicals of, e.g., chlorine, bromine and their compounds, containing, e.g., a free electron, which may then be introduced to the chamber and form or contribute to the in situ plasma at the reflective surfaces of the collector 22.

The chamber may also contain a plurality of, e.g., two sacrificial witness plates or bars 60. The sacrificial witness plates or bars 60 may be observed, e.g., with a respective one of a pair of spectrometers 62, 64 to provide an indication that a base material of the witness plate or bar 60, e.g., molybdenum, ruthenium, silicon or the like is being etched, rather than the source material halogen compound. this can be utilized to control the plasma, e.g., lower the RF energy delivered to the plasma, e.g., the in situ plasma, to suppress unfavorable etching when the witness plates or bars being observed indicate that the source material-halogen compound has bee fully etched away for the time being. In lieu of the spectrometers 62, 64 a monochromator, sensitive to the wavelength emitted when the collector material begins to be etched on the witness plate 60 may be used. The witness plate(s) 60 may be of different base materials, including e.g., molybdenum, ruthenium, silicon, etc.

Figure 5:
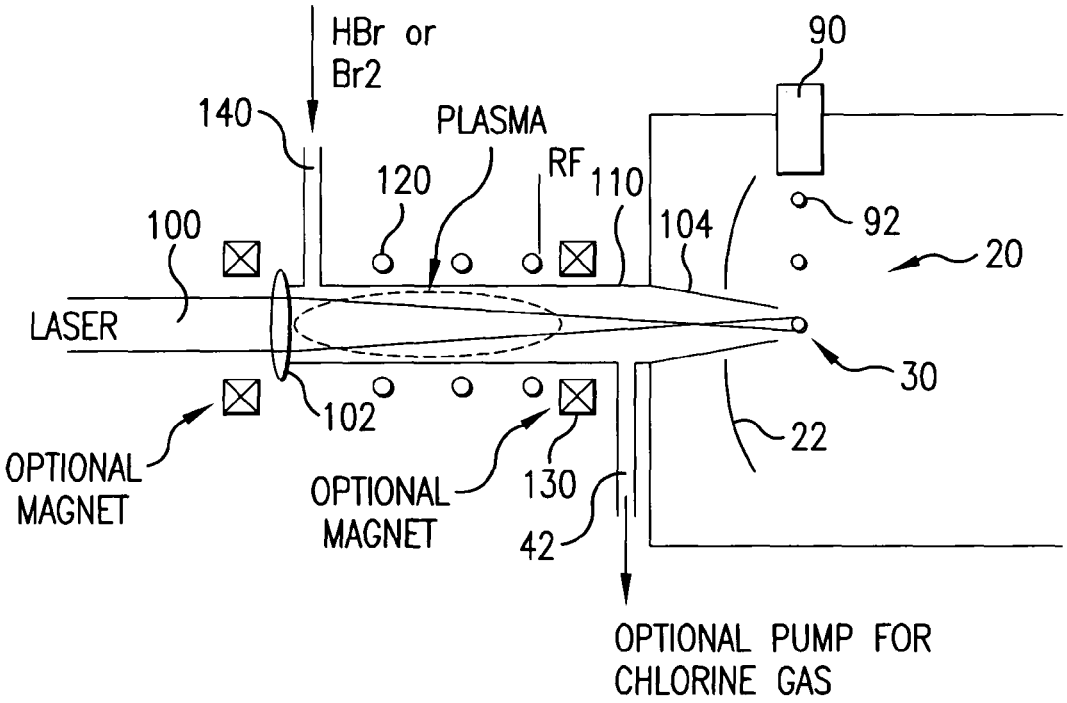
FIG. 5 shows schematically an EUV light source optical element debris mitigation arrangement according to aspects of an embodiment of the present invention.

As shown in FIG. 5 a similar arrangement may be provided for a window/lens 102, which may be contained in a window tube 110, and may serve, e.g., to receive the laser light beam(s) 100 utilized for, e.g., LPP EUV light production. Such a window and other optical elements like it, e.g., for metrology purposes may be part of a laser system subsystem. The tube may have a gas inlet 140 and a gas outlet 142 through which respectively a gas may be circulated through the tube 110. The etchant source gas, as with the chamber gas discussed above, may comprise a suitable halogen, e.g., in the form of HBr or $Br_2$ or HCl or $Cl_2$, and may contribute to the formation of volatile plasma source material-halogen compounds on the side of the window potentially exposed to EUV plasma debris. This etching may be in turn stimulated by an RF induced plasma induced by RF coils 120 and the plasma may be magnetically confined in the tube, e.g., through permanent or electromagnets 130.

For the chamber laser lens/window 102 and other, e.g., diagnostic windows applicants propose to use halogen resistant, e.g., bromine-resistant optical materials such as CaF2 and MgF2. This cleaning may be done by the gas alone (stimulated by laser radiation going through as well as generated EUV radiation). Or, as noted the cleaning may use an RF plasma to stimulate window cleaning.

It will be understood that the laser subsystem optical element may be a window formed directly in the chamber wall, i.e., without the tube 110, and the etchant source gas may be in the chamber. In situ plasma and magnetic confinement may still be employed as noted above according to aspects of this embodiment of the present invention.

The halogen gases may be evacuated from the tube 110 before reaching the EUV plasma production chamber.

Those skilled in the art will appreciate that the above aspects of embodiments of the present invention relate to preferred embodiments only and the scope and intent of the appended claims and the inventions defined therein are not limited to such preferred embodiments.

We claim:

1. An EUV light producing mechanism for producing EUV light from a laser beam and EUV plasma source material that comprises at least tin, comprising:

a tube structure having a first tube end and a second tube end, said second tube end having an opening, said tube structure also having a gas inlet port and a gas outlet port;

an optical element disposed at said first tube end, wherein said laser beam passes through said optical element and exiting said opening at said second tube end;

an EUV plasma generation chamber disposed outside said tube structure, whereby said laser beam interacts with said EUV plasma source material to produce said EUV light in said EUV plasma generation chamber; and a plasma generation system for producing cleaning plasma within said tube structure from an etchant source gas that enters said gas inlet port, whereby byproducts from generating said cleaning plasma is evacuated from said tube structure via said gas outlet port, said gas outlet port being disposed between said cleaning plasma and said second tube end.

2. The EUV light producing mechanism of claim 1 further comprising magnetic confinement means disposed between said gas inlet port and said second tube end for confining said cleaning plasma within said tube structure, thereby preventing said cleaning plasma from entering said EUV plasma generation chamber.

3. The EUV light producing mechanism of claim 1 wherein said etchant source gas comprises a halogen.

4. The EUV light producing mechanism of claim 1 wherein said etchant source gas comprises a halogen compound.

5. The EUV light producing mechanism of claim 1 wherein said plasma generation system includes at least one RF coil configured to generate said cleaning plasma via RF energy.

6. The EUV light producing mechanism of claim 1 wherein said at least one RF coil is disposed around said tube structure.

7. The EUV light producing mechanism of claim 1 wherein said optical element is an optical window.

8. The EUV light producing mechanism of claim 1 wherein said optical element is a lens.

9. The EUV light producing mechanism of claim 1 wherein said cleaning plasma is configured to clean at least said optical element.

10. The EUV light producing mechanism of claim 1 further comprising a collector having at least one reflective surface, said collector including an aperture, said second tube end protruding through said aperture.

11. The EUV light producing mechanism of claim 1 wherein said etchant source gas includes HBr.

12. The EUV light producing mechanism of claim 1 wherein said etchant source gas includes HCl.

13. The EUV light producing mechanism of claim 1 wherein said etchant source gas includes at least one of $Br_2$ and $Cl_2$.

14. An EUV light producing mechanism for producing EUV light from a laser beam and EUV plasma source material that comprises at least tin, comprising:

an EUV plasma generation chamber;

a collector disposed within said EUV plasma generation chamber, said collector having at least one reflective surface, said collector including an aperture for permitting said laser beam to traverse said plasma to irradiate said EUV plasma source material to form a laser produced plasma to generate said EUV light;

a halogen gas source for providing a halogen or halogen compound gas inside said EUV plasma generation chamber; and a cleaning subsystem for stimulating cleaning of said reflective surface, said cleaning subsystem representing at least one of an RF-powered antenna disposed behind said collector for inducing etching of said reflective surface and a remote plasma source for generating in situ plasma from said halogen gas source at said reflective surface, said in situ plasma being different from said laser produced plasma.

15. The EUV light producing mechanism of claim 14 wherein said cleaning subsystem is said RF-powered antenna.

16. The EUV light producing mechanism of claim 14 wherein said cleaning subsystem includes at least two RF-powered antennas, said two RF-powered antennas supplied with different RF frequencies.

17. The EUV light producing mechanism of claim 14 wherein said halogen gas source provides HBr.

18. The EUV light producing mechanism of claim 14 wherein said halogen gas source provides HCl.

19. The EUV light producing mechanism of claim 14 wherein said halogen gas source provides at least one of $Br_2$ and $Cl_2$.

20. The EUV light producing mechanism of claim 14 wherein said reflective surface contains a layer that includes molybdenum.

21. The EUV light producing mechanism of claim 14 wherein said reflective surface contains a layer that includes ruthenium.

* * * * *